US011957186B2

(12) United States Patent
Stanton

(10) Patent No.: US 11,957,186 B2
(45) Date of Patent: Apr. 16, 2024

(54) SEAMLESS GARMENT FOR PUMPING AND NURSING

(71) Applicant: BRAVADO HOLDING AG, Zug (CH)

(72) Inventor: Lisa Stanton, Beeton (CA)

(73) Assignee: BRAVADO HOLDING AG, Zug (CH)

( * ) Notice: Subject to any disclaimer, the term of this patent is extended or adjusted under 35 U.S.C. 154(b) by 183 days.

(21) Appl. No.: 17/704,078

(22) Filed: Mar. 25, 2022

(65) Prior Publication Data

US 2022/0304395 A1 Sep. 29, 2022

Related U.S. Application Data

(60) Provisional application No. 63/200,755, filed on Mar. 25, 2021.

(51) Int. Cl.

| | |
|---|---|
| ***A41C 3/04*** | (2006.01) |
| ***A41C 3/00*** | (2006.01) |
| ***A41C 3/12*** | (2006.01) |

(52) U.S. Cl.

CPC ..... *A41C 3/04* (2013.01); *A41C 3/0014* (2013.01); *A41C 3/12* (2013.01)

(58) Field of Classification Search

CPC ..... A41C 3/12; A41C 3/0014; A41C 3/04
USPC ..... 450/36
See application file for complete search history.

(56) References Cited

U.S. PATENT DOCUMENTS

| | | | |
|---|---|---|---|
| 321,384 | A | 6/1885 | Presley |
| 1,948,076 | A | 2/1934 | Notes |
| 2,679,048 | A | 5/1954 | Alberts |
| 2,738,509 | A | 3/1956 | Bauder |
| D206,854 | S | 2/1967 | Sachs |
| D207,390 | S | 4/1967 | Sachs |
| 3,507,285 | A | 4/1970 | Williams |
| 4,564,015 | A | 1/1986 | Friedman |

(Continued)

FOREIGN PATENT DOCUMENTS

| | | | |
|---|---|---|---|
| AU | 2011100651 | A4 | 7/2011 |
| CA | 2688737 | C | 2/2014 |

(Continued)

OTHER PUBLICATIONS

International Application No. PCT/IB2022/052757, International Search Report and Written Opinion, dated Jun. 30, 2022.

(Continued)

*Primary Examiner* — Gloria M Hale
(74) *Attorney, Agent, or Firm* — MARSHALL, GERSTEIN & BORUN LLP

(57) ABSTRACT

A nursing and pumping garment includes a unitary exterior layer and a pumping layer seamlessly connected to the unitary exterior layer. The unitary exterior layer includes first and second breast covers, a central portion, and gathers between both the first breast cover and the central portion and the second breast cover and the central portion. The garment may be in one of: (1) a first state in which the unitary exterior layer is completely covering a central pumping edge and the garment is neither in a pumping or a breast feeding position; (2) a second state in which at least one aperture is formed to facilitate breast pumping; and (3) a third state in which the unitary exterior and pumping layers are both disconnected from a first bra strap or a second bra strap to facilitate breast feeding.

20 Claims, 10 Drawing Sheets

(56) References Cited

U.S. PATENT DOCUMENTS

| | | | | |
|---|---|---|---|---|
| 4,660,227 | A | 4/1987 | Abramson | |
| 4,667,345 | A | 5/1987 | Jachowski | |
| 4,911,677 | A | 3/1990 | White | |
| 5,034,999 | A | 7/1991 | Lubbers | |
| D321,273 | S | 11/1991 | Hull | |
| 5,086,511 | A | 2/1992 | Kobayashi et al. | |
| 5,514,166 | A | 5/1996 | Silver et al. | |
| 5,575,768 | A | 11/1996 | Lockridge et al. | |
| 5,697,830 | A | 12/1997 | White | |
| 5,848,439 | A | 12/1998 | Huseth et al. | |
| 6,004,186 | A | 12/1999 | Penny | |
| 6,178,784 | B1 | 1/2001 | Marley, Jr. | |
| 6,213,840 | B1 | 4/2001 | Han | |
| 6,227,936 | B1 | 5/2001 | Mendoza | |
| 6,346,027 | B1 | 2/2002 | Merkovsky | |
| 6,440,100 | B1 | 8/2002 | Prentiss | |
| 6,645,041 | B2 | 11/2003 | Sarensen | |
| 6,821,185 | B1 | 11/2004 | Francis | |
| 6,855,029 | B2 | 2/2005 | Rothman | |
| 6,866,558 | B2 | 3/2005 | Luciano et al. | |
| D505,243 | S | 5/2005 | Thunstedt | |
| 6,887,217 | B1 | 5/2005 | Logan | |
| 6,974,361 | B2 | 12/2005 | Cravaack et al. | |
| 7,028,509 | B2 | 4/2006 | Mitchell et al. | |
| 7,051,557 | B2 | 5/2006 | Mitchell et al. | |
| D523,212 | S | 6/2006 | Iourina | |
| 7,081,034 | B1 | 7/2006 | Zoellner | |
| D550,368 | S | 9/2007 | Hankins | |
| D571,529 | S | 6/2008 | Cook | |
| 7,395,556 | B2 | 7/2008 | Eraca | |
| 7,430,883 | B2 | 10/2008 | Sorensen | |
| 7,448,090 | B2 | 11/2008 | Lucock | |
| 7,549,302 | B2 | 6/2009 | Duckham et al. | |
| 7,611,399 | B2 | 11/2009 | Brigham | |
| 7,654,115 | B2 | 2/2010 | Duckham et al. | |
| 7,662,019 | B2 | 2/2010 | Faircloth et al. | |
| D625,487 | S | 10/2010 | Hendrickson | |
| 7,811,248 | B2 | 10/2010 | Bjorge | |
| 7,878,880 | B2 | 2/2011 | Hendrickson | |
| D638,196 | S | 5/2011 | Torres | |
| 7,950,980 | B2 | 5/2011 | Solberg et al. | |
| D641,132 | S | 7/2011 | Sharard | |
| 8,057,452 | B2 | 11/2011 | Fialkoff | |
| 8,137,153 | B2 | 3/2012 | Bell | |
| 8,192,247 | B2 * | 6/2012 | Abbaszadeh | A41C 3/04 2/104 |
| 8,226,452 | B2 | 7/2012 | Hendrickson | |
| 8,323,070 | B2 * | 12/2012 | Abbaszadeh | A61M 1/062 604/74 |
| 8,414,353 | B1 | 4/2013 | Leavell | |
| 8,469,770 | B2 | 6/2013 | Alva | |
| 8,523,629 | B2 | 9/2013 | Pundyk | |
| 8,668,547 | B2 | 3/2014 | Boonen et al. | |
| 8,690,634 | B2 | 4/2014 | Heath et al. | |
| 9,113,660 | B2 | 8/2015 | Op't Hof | |
| 9,155,339 | B2 | 10/2015 | Alva | |
| 9,167,855 | B2 * | 10/2015 | Abbaszadeh | A61M 1/067 |
| D744,718 | S | 12/2015 | Randall | |
| D749,296 | S | 2/2016 | Gamble | |
| 9,402,425 | B2 | 8/2016 | Cortese et al. | |
| D769,576 | S | 10/2016 | Kawasaki | |
| 9,498,005 | B2 | 11/2016 | Abbaszadeh | |
| 9,538,795 | B2 | 1/2017 | Cobb | |
| 9,578,901 | B2 | 2/2017 | Randall et al. | |
| 9,629,396 | B2 | 4/2017 | Alva | |
| 9,706,796 | B2 | 7/2017 | Kawasaki | |
| D799,786 | S | 10/2017 | Hoth | |
| 9,872,524 | B2 | 1/2018 | Abbaszadeh | |
| D810,397 | S | 2/2018 | Beroff | |
| 9,894,942 | B2 | 2/2018 | Burrell | |
| 10,212,972 | B2 | 2/2019 | Abbaszadeh | |
| 10,231,491 | B2 | 3/2019 | Akerson et al. | |
| 10,238,153 | B2 | 3/2019 | Alva | |
| D854,782 | S | 7/2019 | Ironi | |
| 10,368,590 | B2 | 8/2019 | Diaz et al. | |
| 10,405,587 | B2 | 9/2019 | Cortese et al. | |
| 10,420,377 | B2 | 9/2019 | Abbaszadeh | |
| 10,420,378 | B2 | 9/2019 | Kosak | |
| D861,286 | S | 10/2019 | Ye | |
| 10,426,203 | B2 | 10/2019 | Kosak | |
| 10,441,002 | B2 | 10/2019 | Ironi | |
| 10,463,082 | B2 | 11/2019 | Boele et al. | |
| D871,718 | S | 1/2020 | Pan | |
| 10,757,984 | B2 | 9/2020 | Akerson et al. | |
| 10,772,361 | B2 | 9/2020 | Abbaszadeh | |
| 10,905,173 | B1 | 2/2021 | Kosak et al. | |
| 2003/0027491 | A1 | 2/2003 | Cravaack et al. | |
| 2003/0186617 | A1 | 10/2003 | Sorensen | |
| 2003/0191427 | A1 | 10/2003 | Jay et al. | |
| 2003/0199224 | A1 | 10/2003 | Luciano et al. | |
| 2004/0016039 | A1 | 1/2004 | Caprio | |
| 2007/0161330 | A1 | 7/2007 | Whitehead et al. | |
| 2008/0034462 | A1 | 2/2008 | Ekelund et al. | |
| 2008/0034463 | A1 | 2/2008 | Ekelund et al. | |
| 2008/0201817 | A1 | 8/2008 | Ostrander | |
| 2009/0083895 | A1 | 4/2009 | Pellegrini et al. | |
| 2010/0031418 | A1 | 2/2010 | Op't Hof | |
| 2010/0088800 | A1 | 4/2010 | Pate-Gurule | |
| 2010/0159802 | A1 | 6/2010 | Abbaszadeh | |
| 2010/0185144 | A1 | 7/2010 | Bell | |
| 2011/0092134 | A1 * | 4/2011 | Alva | A61M 1/062 450/39 |
| 2011/0104985 | A1 | 5/2011 | Linder et al. | |
| 2011/0314587 | A1 | 12/2011 | Ritchie | |
| 2013/0122780 | A1 | 5/2013 | McCall | |
| 2013/0232661 | A1 | 9/2013 | Huntley | |
| 2013/0273809 | A1 | 10/2013 | Turk et al. | |
| 2014/0087625 | A1 | 3/2014 | Ironi | |
| 2014/0248822 | A1 | 9/2014 | Abbott et al. | |
| 2014/0273737 | A1 | 9/2014 | Cortese et al. | |
| 2014/0364036 | A1 | 12/2014 | Abbaszadeh | |
| 2015/0133028 | A1 | 5/2015 | Applewhite | |
| 2015/0264982 | A1 | 9/2015 | Randall et al. | |
| 2016/0021940 | A1 | 1/2016 | Carney | |
| 2016/0331045 | A1 | 11/2016 | Cortese et al. | |
| 2017/0042256 | A1 | 2/2017 | Kawasaki | |
| 2018/0103691 | A1 | 4/2018 | Alva | |
| 2018/0132542 | A1 | 5/2018 | Abbaszadeh | |
| 2019/0037931 | A1 | 2/2019 | Akerson et al. | |
| 2019/0261698 | A1 | 8/2019 | Akerson et al. | |
| 2019/0289926 | A1 | 9/2019 | Abbaszadeh | |
| 2020/0154793 | A1 | 5/2020 | Kosak | |
| 2021/0345690 | A1 | 11/2021 | Stanton et al. | |

FOREIGN PATENT DOCUMENTS

| | | | |
|---|---|---|---|
| CN | 205285023 | U | 6/2016 |
| CN | 209498610 | U | 10/2019 |
| EP | 1543736 | A1 | 6/2005 |
| EP | 2810572 | A1 | 12/2014 |
| EP | 2810573 | A1 | 12/2014 |
| EP | 3143886 | A1 | 3/2017 |
| GB | 2536541 | A | 9/2016 |
| KR | 20110001216 | U | 2/2011 |
| WO | WO-96/22116 | A1 | 7/1996 |
| WO | WO-2008/051484 | A2 | 5/2008 |
| WO | WO-2013/180644 | A1 | 12/2013 |
| WO | WO-2018/136640 | A1 | 7/2018 |
| WO | WO-2021/155239 | A1 | 8/2021 |

OTHER PUBLICATIONS

Arden All in One Nursing and Handsfree Pumping Bra, retrieved from the Internet at: <https://shop.thedairyfairy.com/arden-all-in-one-nursing-and-handsfree-pumping-bra/>.

Bravado! Designs Sustainable Maternity & Nursing Bra | Body Silk Seamless | Recycled Nylon | Wireless | B-J Cup, downloaded from the Internet at: <https://www.amazon.com/BRAVADO-DESIGNS-Sustainable-Nursing-Seamless/dp/B097S6KJX5/ref=sr_1_1_sspa?crid=36PJIBRB5JM5R&keywords=body+silk+seamless&qid=1647280450&sprefix=body+silk+seamless%2Caps%2C147&sr=8-1-spons&psc=1&spLa=ZW5jcnlwdGVkUXVhbGImaWVyPUEzS1

(56) References Cited

OTHER PUBLICATIONS

VUVFVIT1NaVEpRJmVuY3J5cHRIZEIKPUExMDE1OTI2QVhHNKY3STg3TzkyJmVuY3J5cHRIZEFKSWQ9QTA5OTk5NzRZVFFTTIFWTKJJSKEmd2lkZ2VOTmFtZT1zcF9hdGYmYWNOaW9uPWNsaWNrUmVkaXJIY3QmZG9Ob3RMb2dDbGljaz10cnVI> (offered for sale before Mar. 25, 2021).

Hands-free Breast Pumping, by Amiga500, posted online at: <https://www.instructables.com/id/Hands-free-breast-pumping/>, Mar. 11, 2011.

International Application No. PCT/IB2021/053215, International Search Report and Written Opinion, dated Jul. 9, 2021.

La Leche League Hands-Free Padded Pump Bra 4106, retrieved from the Internet at: <http://www.birthandbaby.com/shop/products/1544> Apr. 7, 2012.

Medela Easy Expression Hands-Free Bustier, posted at amazon.com <http://amazon.com>, earliest date available Aug. 6, 2007, [online], acquired on Apr. 29, 2016. Available from Internet, <URL: <http://www.amazon.com/Medela-Expression-Hands-Free-Bustier-Medium/dp/B002NUWQUM/ref=cm_cr_arp_dproduct_top?ie=UTF8>.

Organic Pump Ease, posted at mothersboutique.com <http://mothersboutique.com>, earliest date available Jul. 3, 2010, [online], acquired on Mar. 30, 2016. Available from Internet, <URL: <http://www.mothersboutique.com/orpuea.html>.

Product Review: The Arden Bra by The Dairy Fairy, Retrieved from the Internet at: <https://www.binxbaby.com/product-review-the-arden-bra-by-the-dairy-fairy/>, May 15, 2013.

Rumina Hands-Free Pump & Nurse; Tank, retrieved from the Internet at: <https://mommygear.com/rumina-hands-free-pump-nurse-tank.htm>, Mar. 29, 2013.

Simple Wishes Hands Free Breast Pumping Bra, posted at mothersboutique.com <http://mothersboutique.com>, earliest date available Sep. 18, 2010, [online], acquired on Mar. 30, 2016. Available from Internet, <URL: <http://www.mothersboutique.com/simplewishesl.html>>.

The Dairy Fairy Arden All-in-One Nursing and Pumping Bra Review, The Measuring Flower Blog, retrieved from the Internet at: <https://measuringflower.com/dairy-fairy/> (2013).

* cited by examiner

SEAMLESS GARMENT FOR PUMPING AND NURSING

CROSS-REFERENCE TO RELATED APPLICATION

This non-provisional application claims the benefit of the filing date of U.S. Provisional Application No. 63/200,755 filed Mar. 25, 2021, entitled "Seamless Garment for Pumping and Nursing," which is hereby incorporated by reference in its entirety.

FIELD OF THE DISCLOSURE

This disclosure relates generally to seamless garments that, while being worn, both enable a nursing woman to breastfeed an infant directly and support the use of a breast pump to extract milk for storage and subsequent feeding of an infant.

BACKGROUND

Breastfeeding of an infant provides numerous benefits to the infant and the breastfeeding woman. Breastmilk typically contains all of the nutrients a baby needs in the exact amounts required for optimal growth and development. Breastfed babies are healthier, having, for example, fewer ear infections. For the breastfeeding woman, breastfeeding reduces post-delivery bleeding and chances of anemia, aids in the uterus returning to its original size after birth, and burns up to an extra 500 calories per day.

A nursing woman can provide breastmilk to an infant in two ways. First, the nursing woman can breastfeed the infant directly. Second, a nursing woman can use a breast pump to extract and store milk for feeding an infant by a bottle. Breast pump systems routinely include a breast shield, which is a funnel-like apparatus having a conical region that is placed against the breast with the nipple in the center of the breast shield. Upon the application of negative pressure, the nipple is drawn toward, and often into, a tubular portion of the breast shield known as the nipple tunnel. The nipple tunnel of the breast shield is connected to other components of a breastmilk collection kit. This connection permits application of intermittent (i.e., cyclical) negative pressure to the interior of the breast shield, and also provides a flow path for breastmilk expressed into the nipple tunnel to be collected in a collection receptacle. A nursing woman generally has to hold the breast shield against her breast manually in order to pump milk. Predictably, holding the breast shield in place is inconvenient and limits the tasks that the woman could otherwise accomplish while pumping.

Many nursing women provide breastmilk to an infant through both direct breastfeeding and by pumping milk for later use. In a single day, a nursing woman may sometimes opt to directly breastfeed and may other times opt to pump milk. For example, a nursing woman with a job outside the home may opt to breastfeed when she is at home with her infant and may opt to pump milk when she is away at work. Nursing women also have a significant portion of their day when they are not directly breastfeeding or pumping milk. For the portion of their day that is unrelated to nursing, a garment that provides the typical aesthetic, comfort, and support of a non-nursing, non-pumping bra is desirable. Although various garments have been developed to facilitate nursing and breast pumping, most are intended to support either nursing or breast pumping as opposed to both nursing and breast pumping. As a result, nursing women are forced to change between garments. Further, many of the garments are not comfortable and do not offer a normal appearance under clothing for the times when breastfeeding or pumping are not being performed. For nursing women, constantly having to change garments is tedious and burdensome.

SUMMARY

According to a first aspect of the present disclosure, a garment for nursing and pumping includes a unitary exterior layer having: (1) a first breast cover and a second breast cover; (2) a bottom band and a central portion between the first breast cover and the second breast cover; (3) a first lateral pumping edge; and (4) a second lateral pumping edge. The garment also includes a pumping layer integral with and seamlessly connected to the unitary exterior layer by the bottom band, and the pumping layer includes a central pumping edge. The garment further includes a first bra clip permanently affixed to the unitary exterior layer and the pumping layer, and a second bra clip permanently affixed to the unitary exterior layer and the pumping layer. The garment still further includes a first bra strap connected to the bottom band and selectively connectable to the first bra clip, and a second bra strap connected to the bottom band and selectively connectable to the second bra clip. So configured, in a first state, the first bra strap is connected to the first bra clip, the second bra strap is connected to the second bra clip, and the unitary exterior layer is completely covering the central pumping edge. In a second state, the first bra strap is connected to the first bra clip, the second bra strap is connected to the second bra clip, and an aperture is formed between the central pumping edge and the first lateral pumping edge or the second lateral pumping edge to facilitate breast pumping. In a third state, the first bra strap is disconnected from the first bra clip or the second bra strap disconnected from the second bra clip to facilitate breast feeding.

According to another aspect of the present disclosure, a garment for nursing and pumping includes a unitary exterior layer having: (1) a first knitting pattern that includes a first breast cover and a second breast cover; (2) a second knitting pattern that includes a bottom band and a central portion between the first breast cover and the second breast cover; (3) gathers between the first breast cover and the central portion; (4) gathers between the second breast cover and the central portion; (5) a first lateral pumping edge; and (6) a second lateral pumping edge. The garment also includes a pumping layer integral with and seamlessly connected to the unitary exterior layer by the bottom band, and the pumping layer has a central pumping edge. The garment further includes a first bra strap connected to the bottom band and selectively connectable to the unitary exterior layer and the pumping layer, and a second bra strap connected to the bottom band and selectively connectable to the unitary exterior layer and the pumping layer. So configured, in a first state, the unitary exterior layer and the pumping layer are both connected to the first bra strap and the second bra strap, and the unitary exterior layer is completely covering the central pumping edge. In a second state, the unitary exterior layer and the pumping layer are both connected to the first bra strap and the second bra strap, and an aperture is formed between the central pumping edge and the first lateral pumping edge or the second lateral pumping edge to facilitate breast pumping. In a third state, the unitary exterior layer and the pumping layer are both disconnected from the first bra strap or the second bra strap to facilitate breast feeding.

According to still another aspect of the present disclosure, a method of manufacturing a garment for nursing and pumping includes producing a tubular knit piece of material that includes a first knitting pattern having a first breast cover and a second breast cover, a second knitting pattern having a bottom band and a central portion between the first breast cover and the second breast cover, and then cutting or casting off the tubular knit piece of material circumferentially. The method also includes folding the tubular knit piece of material along the bottom band to create a unitary exterior layer and a pumping layer, and then sewing the unitary exterior layer to the pumping layer along a neckline edge, a first armpit edge, and a second armpit edge, while leaving a first lateral pumping edge and a second lateral pumping edge of the exterior layer unbound and a central pumping edge of the pumping layer unbound. The method of manufacturing also includes attaching a first bra clip adjacent a first top edge and attaching a second bra clip adjacent a second top edge. The method further includes attaching a first bra strap to the tubular knit piece of material adjacent the first top edge, at the bottom band interiorly of the pumping layer, and at a first back location. In addition, the method includes attaching a second bra strap to the tubular knit piece of material adjacent the second top edge, at the bottom band interiorly of the pumping layer, and at the bottom band at a second back location.

In further accordance with any one of the foregoing exemplary aspects, the garment for nursing and pumping and the method of the manufacturing the garment for nursing and pumping may further include any one or more of the following preferred forms.

In one form, the garment may comprise gathers between the first breast cover and the central portion and gathers between the second breast cover and the central portion.

In another form, the unitary exterior layer and the pumping layer together may form a first armpit edge, and the unitary exterior layer may extend along an upper portion of the first armpit edge and a lower portion of the first armpit edge. In addition, the first lateral pumping edge may be unbound between the upper portion of the first armpit edge and the lower portion of the first armpit edge. Further, the unitary exterior layer and the pumping layer may also together form a second armpit edge, and the unitary layer may extend along an upper portion of the second armpit edge and a lower portion of the second armpit edge. The second lateral pumping edge may likewise be unbound between the upper portion of the second armpit edge and the lower portion of the second armpit edge.

In yet another form, the first lateral pumping edge may curve from the upper portion of the first armpit edge toward the central portion and then may curve back to the lower portion of the first armpit edge. In addition, the second lateral pumping edge may curve from the upper portion of the second armpit edge toward the central portion and may then curve back to the lower portion of the second armpit edge.

In still another form, the pumping layer may extend along all of the first armpit edge and the second armpit edge.

In yet another form, the unitary exterior layer and the pumping layer together may form a neckline edge, and the pumping layer may extend along a first portion of the neckline edge and a second portion of the neckline edge. Further, the central pumping edge may be unbound between the first portion of the neckline edge and the second portion of the neckline edge. In addition, the central pumping edge may curve from the first portion of the neckline edge toward the bottom band and then may curve back to the second portion of the neckline edge.

In still another form, the unitary exterior layer may extend along all of the neckline edge.

According to yet another form, the central portion may be concave at a first side where the central portion connects to the first breast cover, and the central portion may also be concave at a second side where the central portion connects to the second breast cover. In addition, the gathers may be between the first breast cover and the central portion located along the first side of the central portion, and the gathers may also be between the second breast cover and the central portion located along the second side of the central portion.

Further, the second knitting pattern may further include a first lateral portion adjacent the bottom band and the first breast cover, and a second lateral portion adjacent the bottom band and the second breast cover.

In yet another form, the first lateral portion may be concave at a first lateral side where the first lateral portion connects to the first breast cover, and the second lateral portion may be concave at a second lateral side where the second lateral portion connects to the second breast cover.

In still other forms, the second knitting pattern may be ribbed.

In still other forms, producing a tubular knit piece of material that includes a first knitting pattern having a first breast cover and a second breast cover, a second knitting pattern having a bottom band and a central portion between the first breast cover and the second breast cover may further include one or more of: (1) producing the tubular knit piece of material using a circular, flat or Warp knitting machine; or (2) forming gathers between the first breast cover and the central portion and gathers between the second breast cover and the central portion.

Still further, the method of manufacturing may further include sewing elastic along one or more of the first armpit edge, the second armpit edge, and the neckline edge.

In yet another form, the method may further include attaching a first strap clip to the first bra strap, and the first strap clip may be selectively connectable to the first bra clip. In addition, the method may also include attaching a second strap clip to the second bra strap, and the second strap clip may likewise be selectively connectable to the second bra clip.

In another form, the first lateral pumping edge may curve convexly from the armpit edge toward the central portion, and the second lateral pumping edge may curve convexly from the second armpit edge toward the central portion. Further, the central pumping edge may curve convexly from the neckline edge toward the bottom band.

DETAILED DESCRIPTION

Generally, a multipurpose pumping and nursing garment is disclosed. The garment is seamless and includes two layers with interior and exterior cut-outs to form a bottle opening, for example, allowing pumping to occur. As a result, the garment of the present disclosure enables both nursing and breast pumping. Nursing women do not have to change between garments when breast pumping and nursing. Further, the seamless nature provides added comfort to a wearer, and the two layer construction of the garment enables a normal appearance under clothing for the times when breastfeeding or pumping are not being performed. In addition, the garment includes gathers in a center front area for breast capacity. This allows flexibility and adaptability in the fit of the garment for wearers, as breast size typically varies and fluctuates before, during, and after breast pumping and/or breast nursing, for example.

Figure 1:
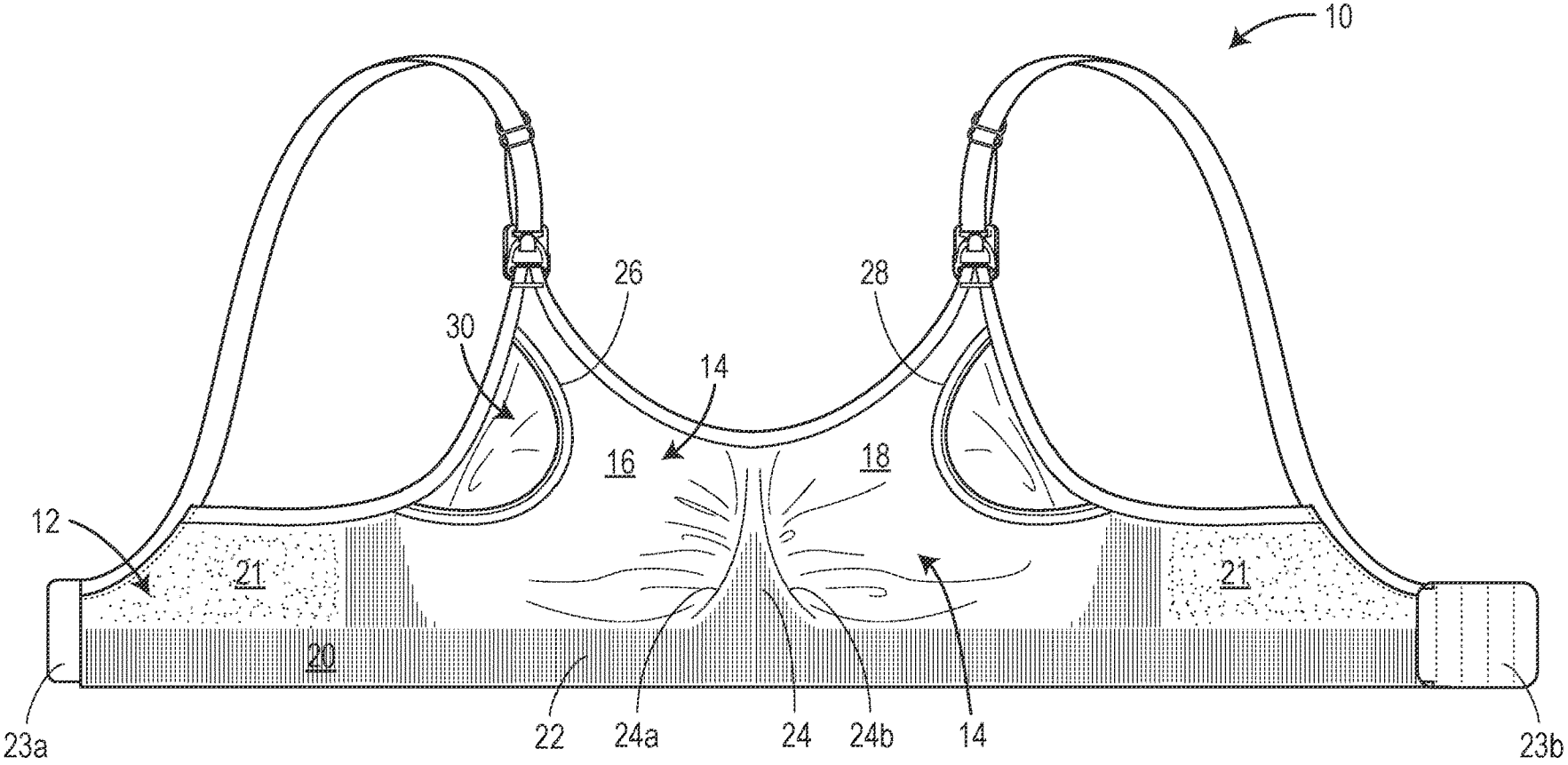
FIG. 1 is a front view of a garment for nursing and pumping in an unfastened state.

Referring now to FIG. 1, a garment for nursing and pumping 10 of the present disclosure is depicted. The garment 10 covers the breasts of a wearer. The garment 10 includes a unitary exterior layer 12 having a first knitting pattern 14 with a first breast cover 16 and a second breast cover 18. The unitary exterior layer 12 also includes a second knitting pattern 20 with a bottom band 22 and a central portion 24 disposed between the first breast cover 16 and the second breast cover 18. The bottom band 22 may be formed from a material having a relatively low modulus of elasticity relative to other material forming the garment 10. The elasticity of the bottom band 22 may allow it to be pulled and stretched around a chest of the wearer, for example, while still allowing the band 22 to fit snugly when positioned beneath the breasts. The bottom band 22 is depicted as including a back connection mechanism 23*a*, 23*b*, such as a back clasp or a back hoop, connected thereto. This allows the garment 10 to be put on by wrapping around a body of the wearer in an unfastened state (of FIG. 1) before being fastened. Alternatively, it will be appreciated that the band 22 may a continuous band that requires the garment 10 to be put on over the head of the wearer.

The unitary exterior layer 12 further includes a third knitting pattern 21 disposed adjacent to the second knitting pattern 20, such as adjacent to a portion of the band 22 of the second knitting pattern 20, and a part of the back connection mechanism 23*a*, 23*b*, as depicted in FIG. 1, for example. More specifically, the third knitting pattern 21 includes a portion of the unitary exterior layer 12 disposed between the first breast portion 16 of the first knitting pattern 14 and a first part 23*a* of the back connection mechanism 23*a*, 23*b*. In addition, the third knitting pattern 21 includes another portion of the unitary exterior layer 12 disposed between the second breast portion 18 of the first knitting pattern 14 and a second part 23*b* of the back connection mechanism 23*a*, 23*b*.

In one example, the first knitting pattern 14 includes a jersey material, the second knitting pattern 20 includes a ribbed knitting pattern or ribbed material, and the third knitting pattern 21 includes a pique knitting pattern. In another example, the garment 10 may be designed with only jersey material and a ribbed knitting pattern, such as the first and third knitting patterns 14, 21 include the jersey material and the second knitting pattern 20 includes the ribbed knitting pattern. It will be appreciated that the garment 10 may alternatively and/or additionally include various other combinations and/or types of materials comprising one or more of the first, second, and third knitting patterns 14, 20, 21 and still fall within the scope of the present disclosure.

Further, in this example, the entire garment 10 includes the same modulus of elasticity. More specifically, in another example, each of the first, second and third knitting patterns 14, 20, 21, e.g., the entire garment, may have the same percentage of spandex material. The difference in any stretchability of the first, second and third knitting patterns 14, 20, 21 may be a function of combining the knitting pattern and the tension in a specific knitting pattern, for example.

As further depicted in FIG. 1, the central portion 24 of the second knitting pattern 20 is concave at a first side 24*a* of the central portion 24 where the central portion 24 connects to the first breast cover 16. In a similar manner, the central portion 24 is also concave at a second side 24*b* where the central portion 24 connects to the second breast cover 18. In addition, the unitary exterior layer 12 of the garment also includes a first lateral pumping edge 26 and a second lateral pumping edge 28, which will be explained in more detail below. The garment 10 further includes a pumping layer 30 that is integral with and seamlessly connected to the unitary exterior layer 12 by the bottom band 22, as also explained more below. This integral and seamless configuration provides significant comfort to the wearer and a normal appearance under the clothing of the wearer.

Figure 2:
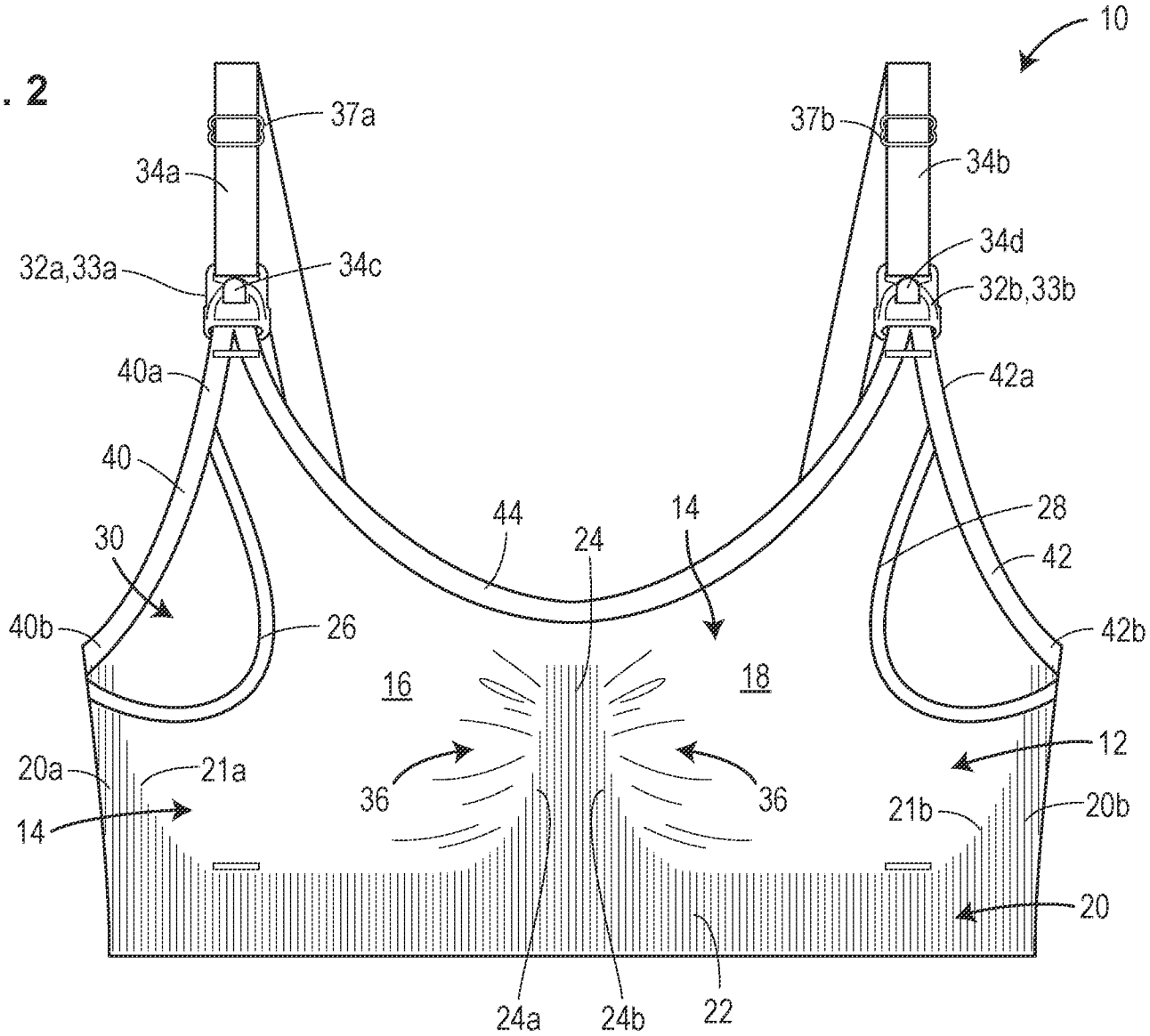
FIG. 2 is a front view of the garment of FIG. 1 in a fastened state.
Figure 3:
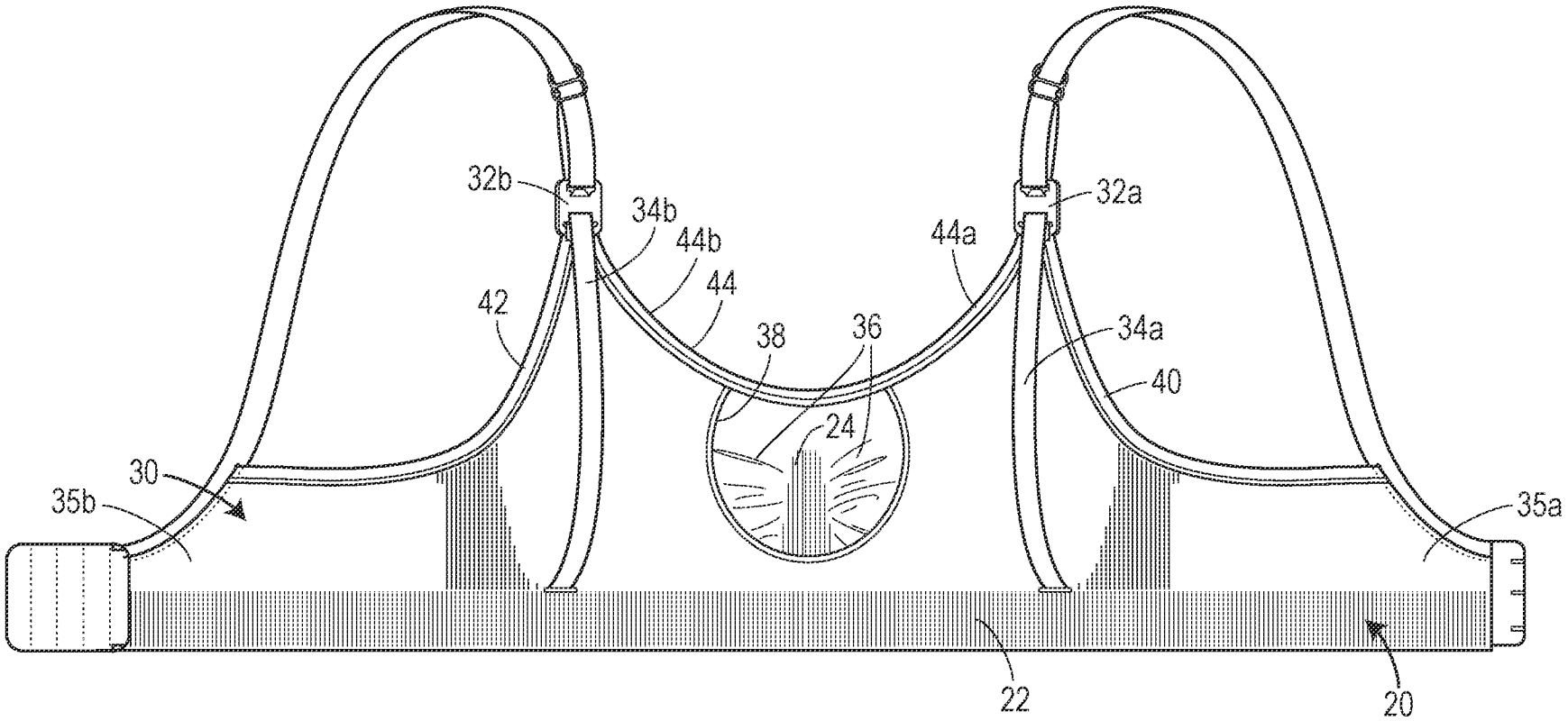
FIG. 3 is a back interior view of the garment of FIGS. 1 and 2 in an unfastened state.

Referring now to FIGS. 2 and 3, the garment 10 further includes a first bra clip 32*a* and a second bra clip 32*b*. The first bra clip 32*a* is permanently fixed to the unitary exterior layer 12 and the pumping layer 30, and the second bra clip 32*b* is likewise permanently affixed to the unitary exterior layer 12 and the pumping layer 30, as depicted in FIG. 2, for example. In this example, the first and second bra clips 32*a*, 32*b* may each include a ring 33*a*, 33*b*, respectively.

In addition, and as depicted in FIG. 3, a first bra strap 34*a* is connected to the bottom band 22 interiorly of the pumping layer 30, and at a first back location 35*a* of the unitary exterior layer 12. The first bra strap 34*a* is also selectively connectable to the first bra clip 32*a*. Likewise, a second bra strap 34*b* is connected to the bottom band 22 interiorly of the pumping layer 30 and at a second back location 35*a* of the unitary exterior layer 12. The second bra strap 34*b* is also selectively connectable to the second bra clip 32*b*.

Specifically, the first bra strap 34*a* may include a first strap clip 34*c* and the second bra strap 34*b* may include a second strap clip 34*d*, such that the ring 33*a* of the first bra clip 32*a* may be configured to attach to, such as hook over, the first strap clip 34*c* of the first bra strap 34*a*. In a similar manner, the ring 33*b* of the second bra clip 32*b* may be configured to attach to, such as hook over, the second strap clip 34*d* of the second bra strap 34*b*. When the first bra clip 32*a* is attached to the first strap clip 34*c* of the first bra strap 34*a*, and the second bra clip 32*b* is attached to the second strap clip 34*d* of the second bra strap 34*b*, as shown in FIG. 2, the unitary exterior layer 12 covers the majority of the pumping layer 30 and a central pumping edge (not shown in FIG. 2, but shown in FIG. 3), as explained more below.

Moreover, it will be understood that the first bra strap 34*a* and the second bra strap 34*b* are configured to extend over first and second shoulders, respectively, of the wearer and may be adjustable in length to allow the wearer to achieve proper support from the garment 10. Specifically, and in one example, the first bra strap 34*a* may include a first slider 37*a*, and the second bra strap 34*b* may include a second slider 37*b*. A portion of the first bra strap 34*a* or a portion of the second bra strap 34*b* may be doubled over to achieve a certain or desired length. The first and second sliders 37*a*, 37*b* allow adjustment of the length of the doubled over portions and hold any doubled over portions in place when adjustment is complete.

As depicted in FIG. 2, the unitary exterior layer 12 also includes gathers 36 disposed between the first breast cover 16 and the central portion 24 and gathers 36 between the second breast cover 18 and the central portion 24. More specifically, the gathers 36 between the first breast cover 16 and the central portion 24 are located along the first side 24*a* of the central portion 24, and the gathers 36 between the second breast cover 18 and the central portion 24 are located along the second side 24*b* of the central portion 24. The gathers 36 provide a feature of adjustable capacity for the wearer. This is a beneficial feature for a nursing and pumping garment 10 at least because the size of the breasts of the wearer may regularly fluctuate depending upon the presence or absence of milk within the breasts. In addition, and as depicted in FIG. 3, the pumping layer 30 includes a central pumping edge 38. As depicted in FIGS. 2 and 3, the unitary exterior layer 12 covers the central pumping edge 38 in a first state, as explained more below.

Referring to FIG. 2, the second knitting pattern 20 of the unitary exterior layer 12 includes a first lateral portion 20*a* adjacent the bottom band 22 and the first breast cover 16, and a second lateral portion 20*b* adjacent the bottom band 22 and the second breast cover 18. The first lateral portion 20*a* may be concave at a first lateral side 21*a* where the first lateral portion 20*a* connects to the first breast cover 16, as depicted. Likewise, the second lateral portion 20*b* may be concave at a second lateral side 21*b* where the second lateral portion 20*b* connects to the second breast cover 18. Further, in this example, the second knitting pattern 20 is ribbed. It will be understood that the second knitting pattern 20 may additionally or alternatively include other patterns different from the first knitting pattern 14, for example, and still fall within the scope of the present disclosure, as explained above.

As depicted in FIGS. 2-3, the unitary exterior layer 12 and the pumping layer 30 together form a first armpit edge 40 having an upper portion 40*a* and a lower portion 40*b*, such that the unitary exterior layer 12 extends along both the upper portion 40*a* of the first armpit edge 40 and the lower portion 40*b* of the first armpit edge 40. The first lateral pumping edge 26 is unbound between the upper portion 40*a* of the first armpit edge 40 and the lower portion 40*b* of the first armpit edge 40, as depicted in FIG. 2, for example. In addition, the unitary exterior layer 12 and the pumping layer 30 also together form a second armpit edge 42 having an upper portion 42*a* and a lower portion 42*b*. The unitary exterior layer 12 extends along the upper portion 42*a* of the second armpit edge 42 and the lower portion 42*b* of the second armpit edge 42. In addition, the second lateral pumping edge 28 is unbound between the upper portion 42*a* of the second armpit edge 42 and the lower portion 42*b* of the second armpit edge.

As also depicted in FIG. 2, for example, the first lateral pumping edge 26 curves from the upper portion 40*a* of the first armpit edge 40 toward the central portion 24 and then curves back to the lower portion 40*b* of the first armpit edge 40. In a similar manner, the second lateral pumping edge 28 curves from the upper portion 42*a* of the second armpit edge 42 toward the central portion 24 and then curves back to the lower portion 42*b* of the second armpit edge 42. The pumping layer 30 extends along all of the first armpit edge 40 and the second armpit edge 42.

Figure 4:
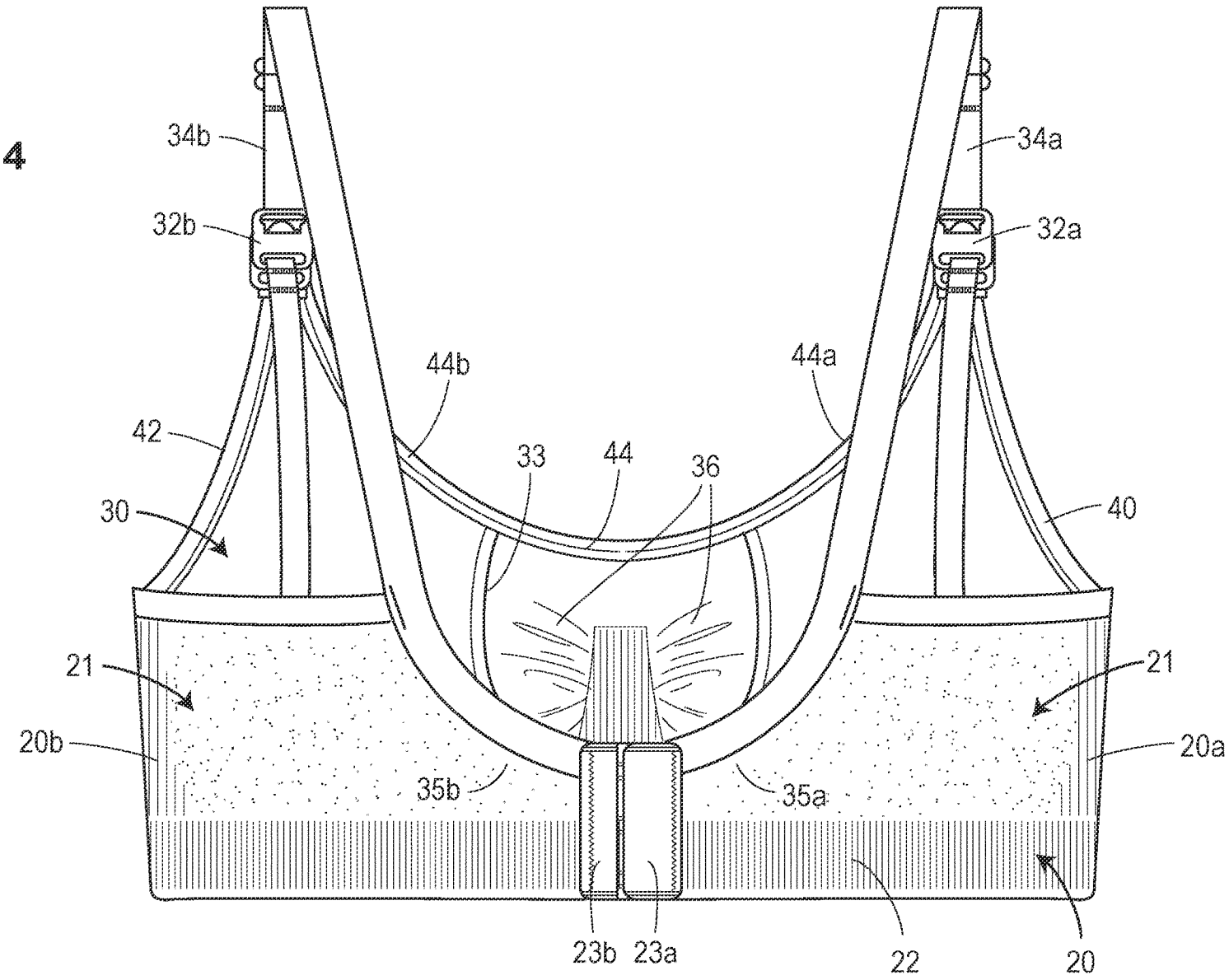
FIG. 4 is a back view of the garment of FIGS. 1 and 2 in a fastened state.

As depicted in FIGS. 2-4, the unitary exterior layer 12 and the pumping layer 30 also together form a neckline edge 44. The neckline edge 44 includes a first portion 44*a* and a second portion 44*b*. The pumping layer 30 extends along the first portion 44*a* of the neckline edge 44 and the second portion 44*b* of the neckline edge, as depicted in FIG. 3. In addition, the central pumping edge 38 is unbound between the first portion 44*a* of the neckline edge 44 and the second portion 44*b* of the neckline edge 44, as also depicted in FIGS. 3 and 4. The central pumping edge 38 curves from the first portion 44*a* of the neckline edge 44 toward the bottom band 22 and then curves back to the second portion 44*b* of the neckline edge 44. The unitary exterior layer 12 extends along all of the neckline edge 44, as depicted in FIG. 2.

As further depicted in FIG. 4, the third knitting pattern 21 includes a portion disposed between the first lateral portion 20*a* of the second knitting pattern 20 and the first part 23*a* of the back connection mechanism 23*a*, 23*b*. In addition, the third knitting pattern 21 also includes another portion disposed between the second lateral portion 20*b* of the second knitting pattern 20 and the second part 23*b* of the back connection mechanism 23*a*, 23*b*.

Figure 5:
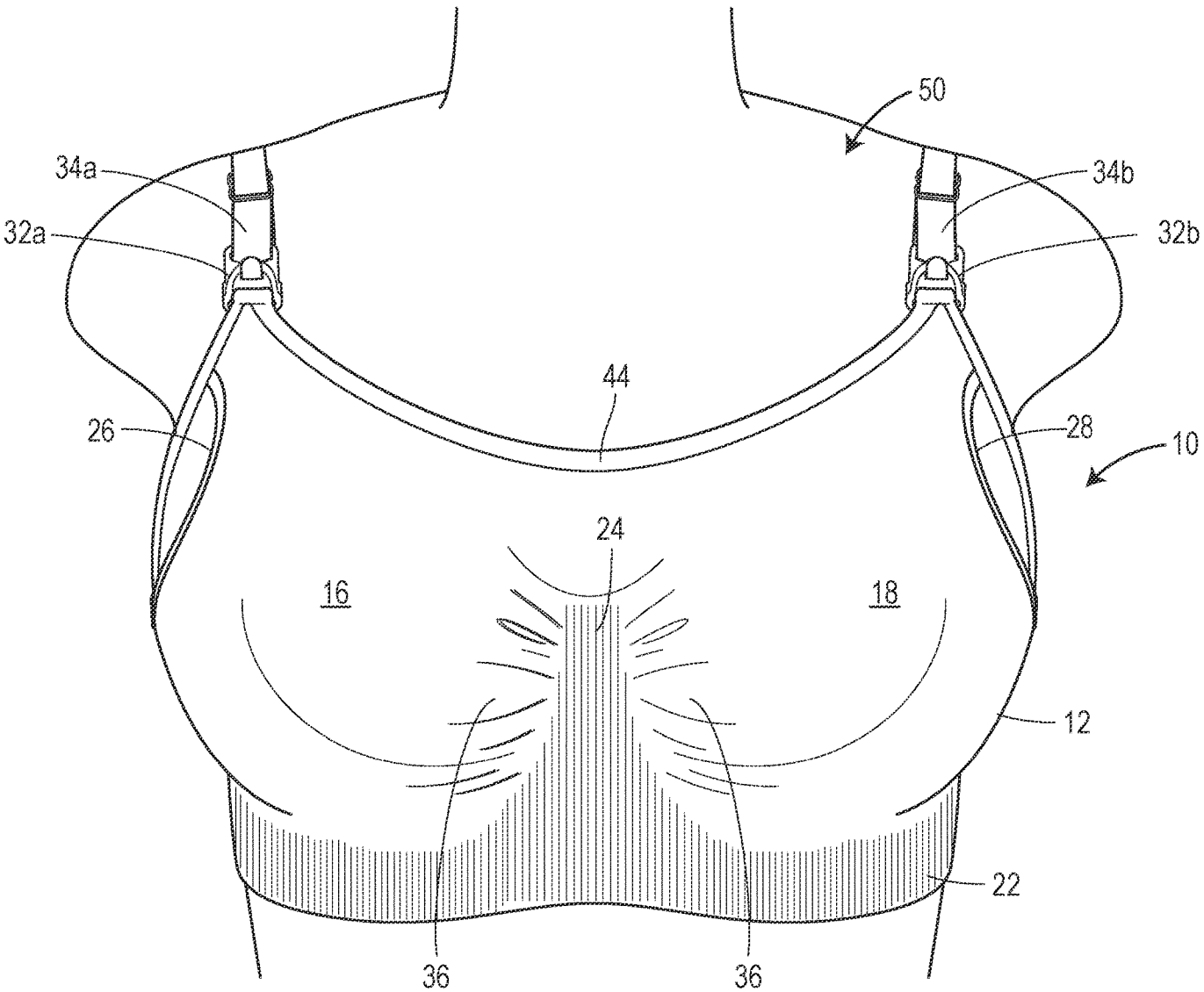
FIG. 5 is a perspective view of the garment for nursing and pumping of FIG. 1 on a wearer.

Referring now to FIG. 5, the garment 10 is shown on a wearer 50 in a first state, in which the garment 10 is in neither a pumping position nor a nursing position. Specifically, in the first state, the first bra strap 34*a* is connected to the first bra clip 32*a*, and the second bar strap 34*b* is connected to the second bra clip 32*b*. In addition, the unitary exterior layer 12 is completely covering the central pumping edge 38 (FIGS. 3 and 4). Said another way, in the first state, the unitary exterior layer 12 and the pumping layer 30 are both connected to the first bra strap 34*a* and the second bra strap 34*b*, such that the unitary exterior layer 12 is completely covering the central pumping edge 38 of the pumping layer 30. As is understood and shown, the first bra strap 34*a* is configured to and/or extends over a first shoulder of the wearer 50, and the second bra strap 34*b* is configured to and/or extends over a second shoulder of the wearer 50.

Referring now to FIG. 6, the garment 10 is again shown on the wearer 50, but in a second state, in which the garment 10 is in a pumping position. Specifically, in the second state, the first bra strap 34*a* is connected to the first bra clip 32*a*, and the second bra strap 34*b* is connected to the second bra clip 34*b*, which is similar to the first state of FIG. 5, for example. Said another way, in the second state the unitary exterior layer 12 and the pumping layer 30 are both connected to the first bra strap 34*a* and the second bra strap 34*b*. However, and unlike the first state, in the second state an aperture 52*a*, 52*b* is formed between the central pumping edge 38 and the first lateral pumping edge 26 or the second lateral pumping edge 28 to facilitate breast pumping. Specifically, in FIG. 6, the aperture 52*a* is formed between the central pumping edge 38 and the first lateral pumping edge 26 to accommodate insertion of a breast shield 54 that is connected to a bottle 56 for the collection of breast milk during breast pumping.

Figure 6:
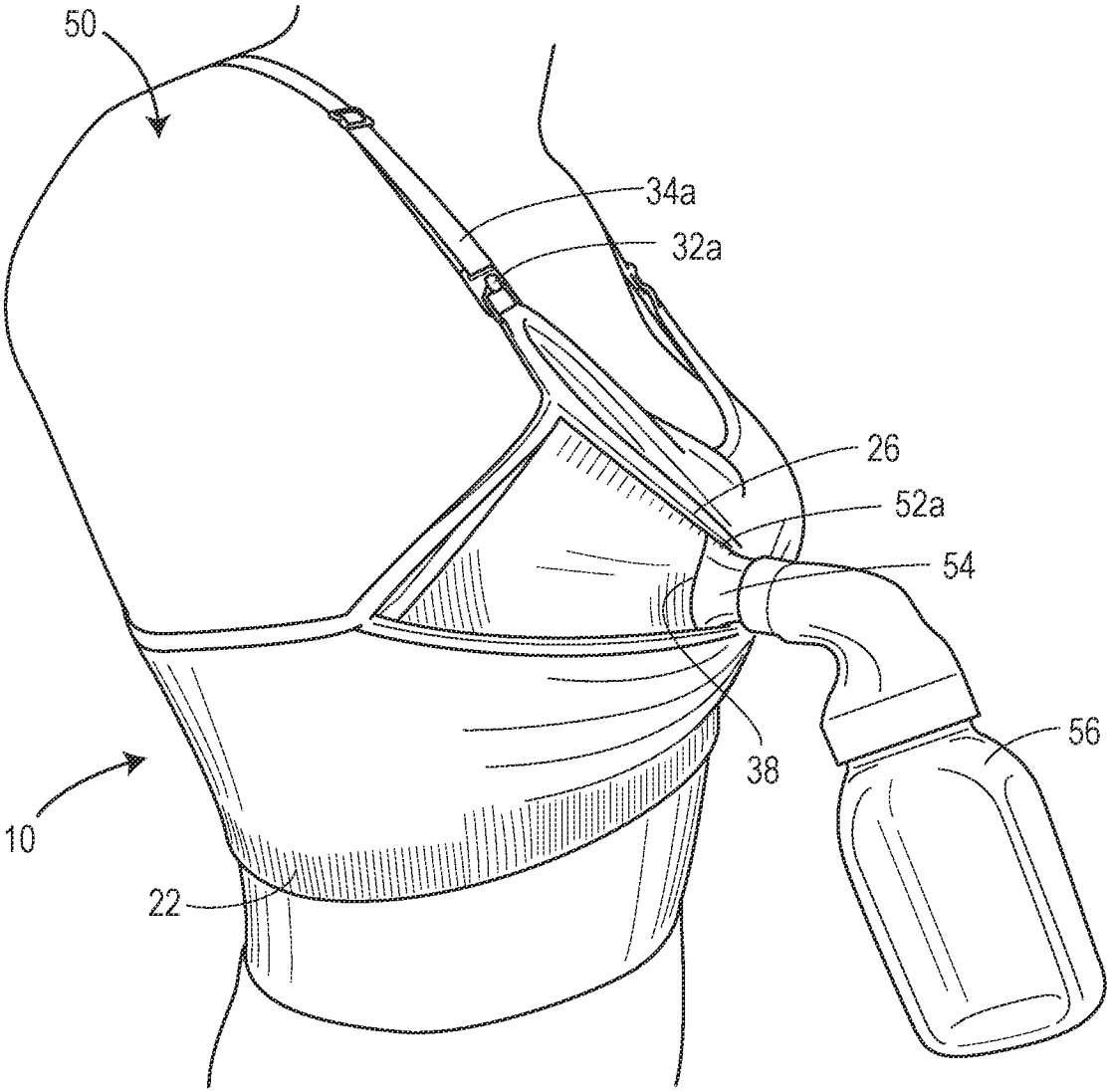
FIG. 6 is a perspective view of the garment for nursing and pumping of FIG. 1 on a wearer with one side of the garment in a pumping position.

Although not depicted in FIG. 6, it will be understood that another aperture 52*b* (not shown) may alternatively and/or additionally be formed between the central pumping edge 38 and the second lateral pumping edge 28, e.g., on a side of the garment 10 opposite to the first lateral pumping edge 26 and adjacent to the second breast cover 18. The aperture 52*b* likewise accommodates insertion of the breast shield 54 or another similar breast shield that is again connected to the bottle 56 or another bottle similar to the bottle 56 (e.g., if or when both of the apertures 52*a*, 52*b* are formed) to facilitate breast pumping on one or both breasts of the wearer 50.

Figure 7:
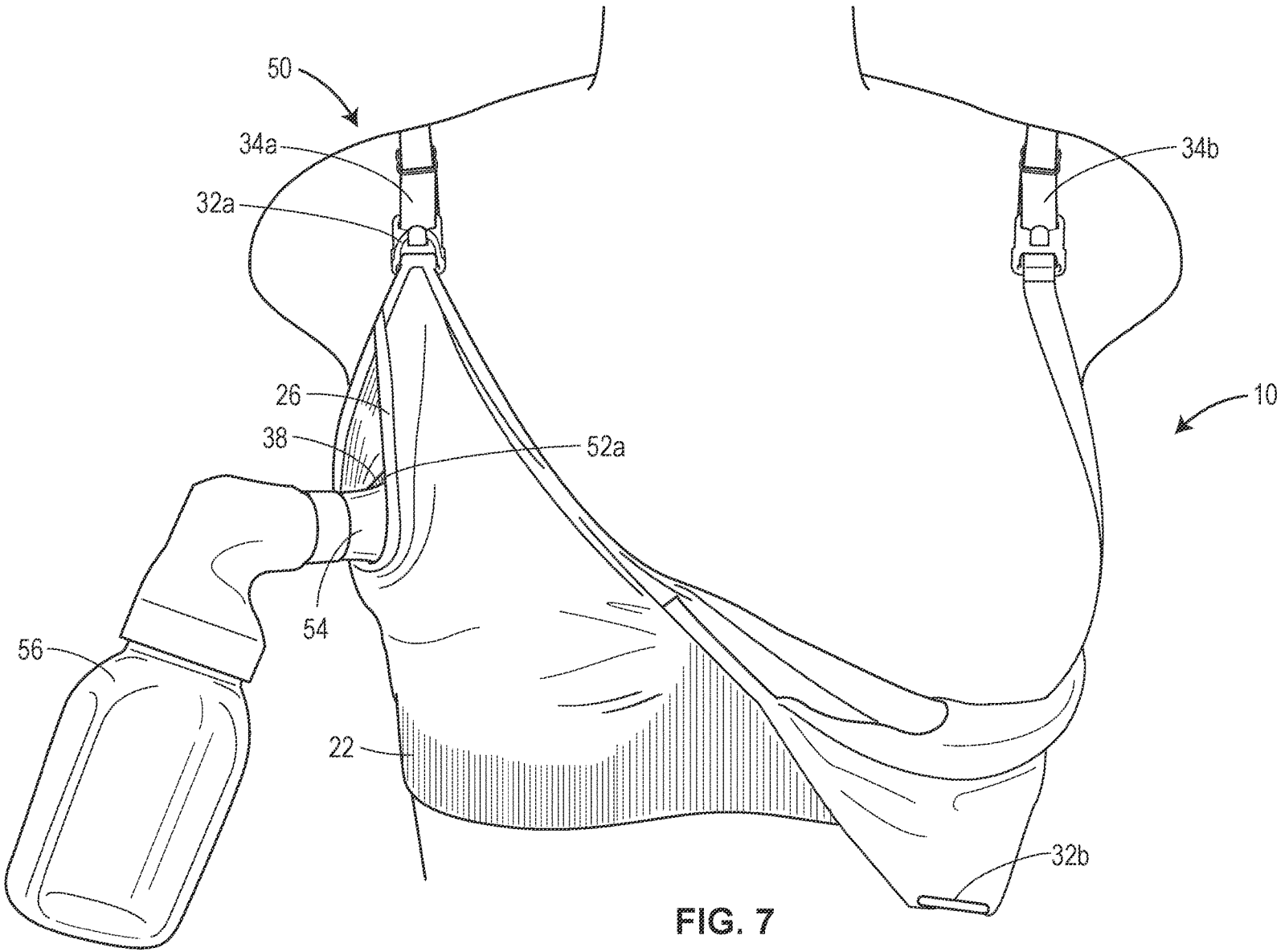
FIG. 7 is a perspective view of the garment for nursing and pumping of FIG. 1 on a wearer with one side of the garment in a pumping position and another side of the garment in a nursing position.

Referring now to FIG. 7, the garment 10 is depicted on the wearer 50 in a third state in which the garment 10 is in both a pumping position and a breast feeding position. Generally, in the third state of the garment 10, the first bra strap 34*a* may be disconnected from the first bra clip 32*a*, and the second bra strap 34*b* may be disconnected from the second bra clip 32*b* to facilitate breast feeding. Said another way, in the third state the unitary exterior layer 12 and the pumping layer 30 are both disconnected from the first bra strap 34*a* or the second bra strap 34*b* to facilitate breast feeding. Specifically, and in the example depicted in FIG. 7, the second bra strap 34*b* is disconnected from the second bra clip 32*b* to facilitate breast feeding, and the first bra strap 34*a* remains connected to the first bra clip 32*a* to facilitate breast pumping. Although not depicted in FIG. 7, it will be appreciated that in another example the first bra strap 34*a* is disconnected from the first bra clip 32*a* to facilitate breast feeding, and the second bra trap 34*b* remains connected to the second bra clip 32*b* to facilitate breast pumping and still be in the third state and fall within the scope of the present disclosure. As such, this flexibility allows the garment 10 to be a 2-in-1 garment that enables both breast pumping and breast feeding simultaneously and easily, while providing comfort and adaptability to the wearer.

Figure 8A:
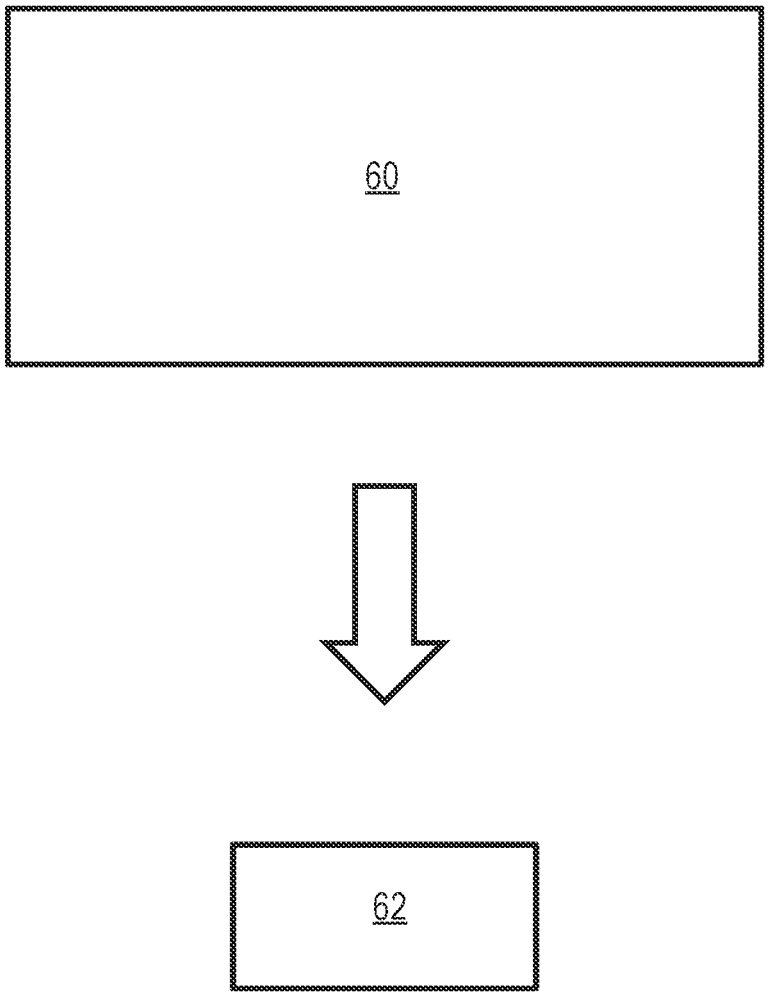
FIG. 8A is a schematic view of a machine for producing a tubular knit piece of material manufactured to form the garment of the present disclosure.
Figure 8B:
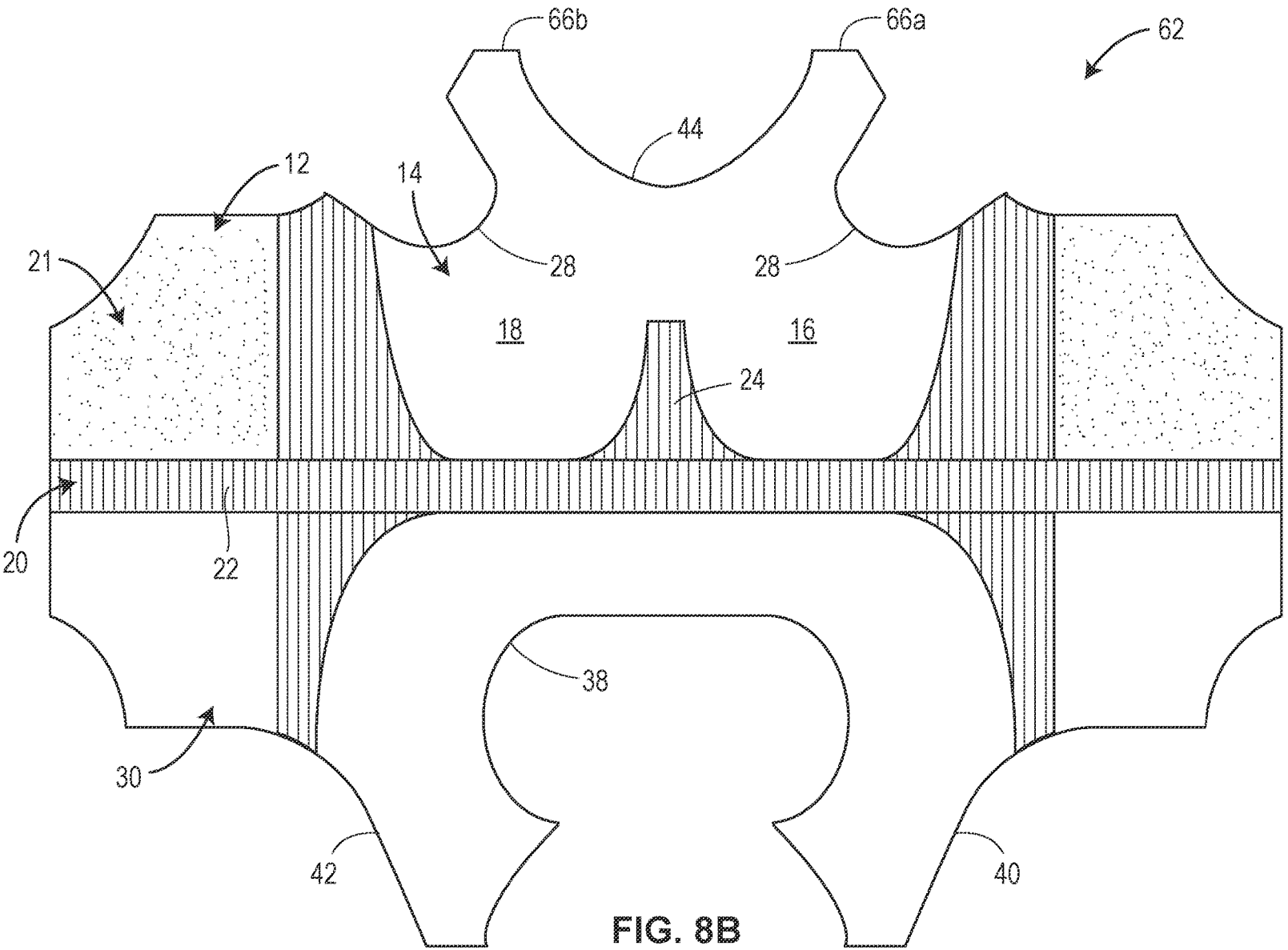
FIG. 8B is a perspective view of the tubular knit piece of material of FIG. 8B.

Referring now to FIGS. 8A and 8B, a circular, flat or Warp knitting machine 60 is depicted that may produce a tubular knit piece of material 62. The tubular knit piece of material 62 is ultimately formed into the garment 10 of the present disclosure, as explained more below. It will be appreciated that the circular, flat or Warp knitting machine 60 includes all of the features known to such machines. Alternatively and/or additionally, another machine may be used to produce the tubular knit piece of material 62 having the features described and still fall within the scope of the present disclosure.

As depicted in FIG. 8A, the circular, flat or Warp knitting machine 60 produces the tubular knit piece of material 62 including the first knitting pattern 14 with the first breast cover 16 and the second breast cover 18, the second knitting pattern 20 with the bottom band 22, and the central portion 24 disposed between the first breast cover 16 and the second breast cover 18. In particular, FIG. 8B depicts the tubular knit piece of material 62 before it is folded along the bottom band 22 to form the unitary exterior layer 12 and the pumping layer 30 described above. FIG. 8B also depicts the central pumping edge 38 before the tubular knit piece of material 62 is folded and various parts sewn together to form the pumping layer 30.

Figure 9:
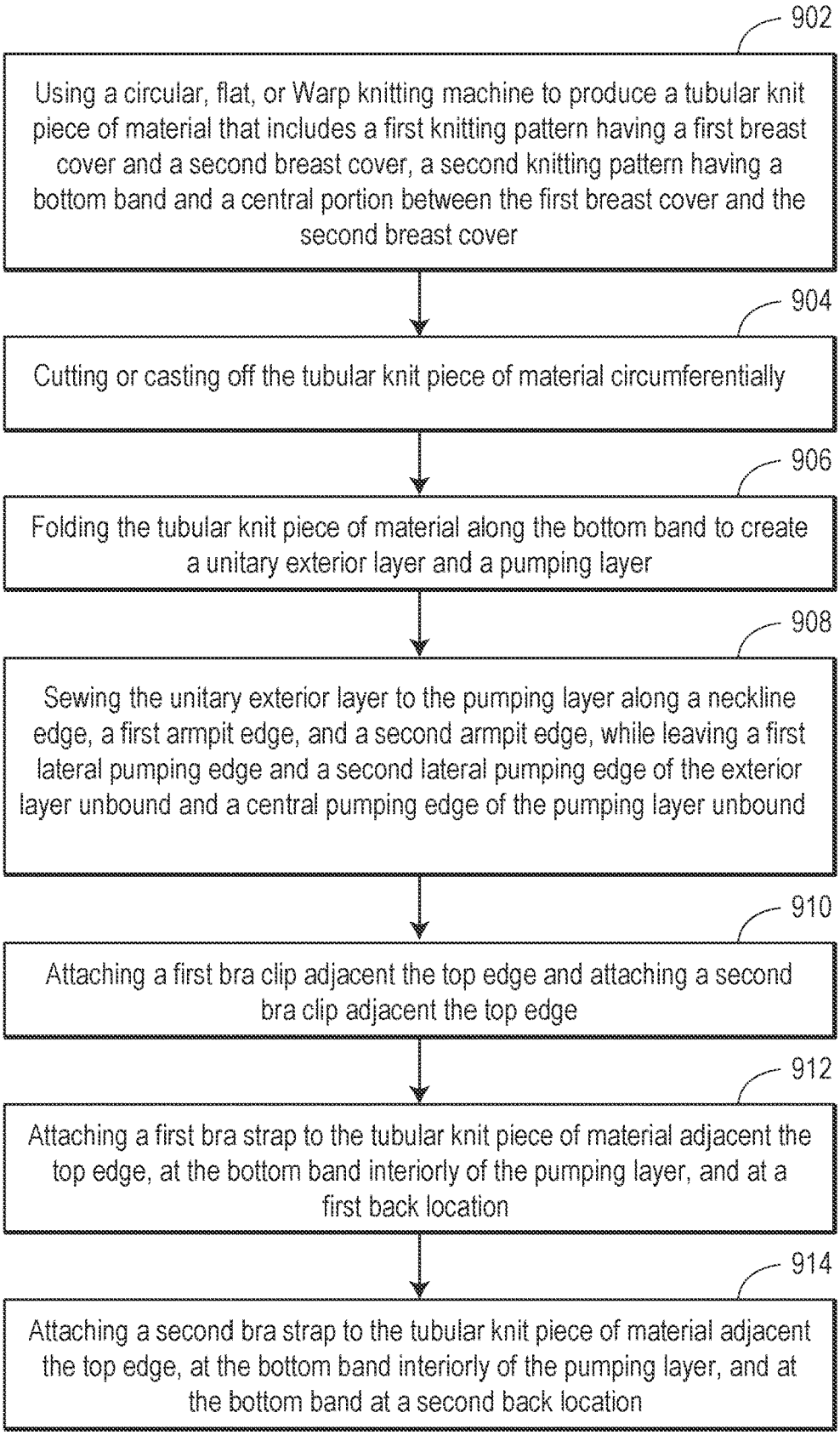
FIG. 9 is a flow chart depicting a method of manufacturing the garment of the present disclosure.

Referring now to FIG. 9, it will be appreciated that the garment 10 may be manufactured according to the following method of manufacturing. In particular, in block 902, the method of manufacturing the garment 10 first includes using the circular, flat or Wrap knitting machine 60 to produce the tubular knit piece of material 62 including the first knitting pattern 14 having the first breast cover 16 and the second breast cover 18, the second knitting pattern 20 having the bottom band 22 and the central portion 24 between the first breast cover 16 and the second breast cover 18.

In block 904, the method then includes cutting or casting off the tubular knit piece of material 62 circumferentially. Then in block 906, the method includes folding the tubular knit piece of material 62 along the bottom band 22 to create the unitary exterior layer 12 and the pumping layer 30.

In block 908, the method of manufacturing the garment 10 further includes sewing the unitary exterior layer 12 to the pumping layer 30 along the neckline edge 44, the first armpit edge 40, and the second armpit edge 42. The method also includes leaving the first lateral pumping edge 26 and the second lateral pumping edge 28 of the unitary exterior layer 12 unbound and leaving the central pumping edge 38 unbound. This construction allows the apertures, such as 52*a*, to be formed in the pumping position to accommodate insertion of a breast shield through the aperture, facilitating pumping.

In block 910, the method further includes attaching the first bra clip 32*a* to the tubular knit piece of material 60 adjacent a top edge 66*a* (FIG. 8B) and attaching the second bra clip 32*b* adjacent another top edge 66*b* (FIG. 8B).

In block 912, the method also includes attaching the first bra strap 34*a* to the tubular piece of material 62 adjacent the top edge 66*a*, at the bottom band 22 interiorly of the pumping layer 30, and at the first back location 35*a*. In block 914, the method further includes attaching the second bra strap 34*b* to the tubular piece of material 60 adjacent to the top edge 66*b*, at the bottom band 22 interiorly of the pumping layer, and at the second back location 35*b*.

While the present disclosure has been described with respect to certain embodiments, it will be understood that variations may be made thereto that are still within the scope of the appended claims. Additionally, while a particularly-preferred embodiment is illustrated in the drawings of the present disclosure, it will be understood that the functional features disclosed and claimed herein can be accomplished in devices that differ ornamentally from these drawings, and ornamental features of the drawings are not dictated by function.

What is claimed is:

1. A garment for nursing and pumping comprising:

a unitary exterior layer having a first breast cover and a second breast cover, a bottom band and a central portion between the first breast cover and the second breast cover, a first lateral pumping edge, and a second lateral pumping edge;

a pumping layer integral with and seamlessly connected to the unitary exterior layer by the bottom band, the pumping layer having a central pumping edge;

a first bra clip permanently affixed to the unitary exterior layer and the pumping layer, and a second bra clip permanently affixed to the unitary exterior layer and the pumping layer;

a first bra strap connected to the bottom band and selectively connectable to the first bra clip, and a second bra strap connected to the bottom band and selectively connectable to the second bra clip;

in a first state, the first bra strap connected to the first bra clip, the second bra strap connected to the second bra clip, and the unitary exterior layer completely covering the central pumping edge;

in a second state, the first bra strap connected to the first bra clip, the second bra strap connected to the second bra clip, and an aperture formed between the central pumping edge and the first lateral pumping edge or the second lateral pumping edge to facilitate breast pumping; and in a third state, the first bra strap disconnected from the first bra clip or the second bra strap disconnected from the second bra clip to facilitate breast feeding.

2. The garment of claim 1, further comprising gathers between the first breast cover and the central portion and gathers between the second breast cover and the central portion.

3. The garment of claim 1, the unitary exterior layer and the pumping layer together forming a first armpit edge, the unitary exterior layer extending along an upper portion of the first armpit edge and a lower portion of the first armpit edge, the first lateral pumping edge unbound between the upper portion of the first armpit edge and the lower portion of the first armpit edge;

the unitary exterior layer and the pumping layer together forming a second armpit edge, the unitary layer extending along an upper portion of the second armpit edge and a lower portion of the second armpit edge, the second lateral pumping edge unbound between the upper portion of the second armpit edge and the lower portion of the second armpit edge.

4. The garment of claim 3, and the first lateral pumping edge curves from the upper portion of the first armpit edge toward the central portion and then curves back to the lower portion of the first armpit edge, and the second lateral pumping edge curves from the upper portion of the second armpit edge toward the central portion and then curves back to the lower portion of the second armpit edge.

5. The garment of claim 3, the pumping layer extending along all of the first armpit edge and the second armpit edge.

6. The garment of claim 1, the unitary exterior layer and the pumping layer together forming a neckline edge, the pumping layer extending along a first portion of the neckline edge and a second portion of the neckline edge, the central pumping edge unbound between the first portion of the neckline edge and the second portion of the neckline edge.

7. The garment of claim 6, and the central pumping edge curves from the first portion of the neckline edge toward the bottom band and then curves back to the second portion of the neckline edge, the unitary exterior layer extending along all of the neckline edge.

8. The garment of claim 1, further comprising a first knitting pattern including the first breast cover and the second breast cover, a second knitting pattern including the bottom band and the central portion between the first breast cover and the second breast cover, and a third knitting pattern disposed adjacent to the second knitting pattern.

9. A garment for nursing and pumping comprising:

a unitary exterior layer having a first knitting pattern that includes a first breast cover and a second breast cover, a second knitting pattern that includes a bottom band and a central portion between the first breast cover and the second breast cover, gathers between the first breast cover and the central portion, gathers between the second breast cover and the central portion, a first lateral pumping edge, and a second lateral pumping edge;

a pumping layer integral with and seamlessly connected to the unitary exterior layer by the bottom band, the pumping layer having a central pumping edge;

a first bra strap connected to the bottom band and selectively connectable to the unitary exterior layer and the pumping layer;

a second bra strap connected to the bottom band and selectively connectable to the unitary exterior layer and the pumping layer;

in a first state, the unitary exterior layer and the pumping layer both connected to the first bra strap and the second bra strap, the unitary exterior layer completely covering the central pumping edge;

in a second state, the unitary exterior layer and the pumping layer both connected to the first bra strap and the second bra strap, an aperture formed between the central pumping edge and the first lateral pumping edge or the second lateral pumping edge to facilitate breast pumping; and in a third state, the unitary exterior layer and the pumping layer both disconnected from the first bra strap or the second bra strap to facilitate breast feeding.

10. The garment of claim 9, the central portion being concave at a first side where the central portion connects to the first breast cover, and the central portion being concave at a second side where the central portion connects to the second breast cover, the gathers between the first breast cover and the central portion located along the first side of the central portion, and the gathers between the second breast cover and the central portion located along the second side of the central portion.

11. The garment of claim 9, the second knitting pattern further including a first lateral portion adjacent the bottom band and the first breast cover, and a second lateral portion adjacent the bottom band and the second breast cover.

12. The garment of claim 11, the first lateral portion being concave at a first lateral side where the first lateral portion connects to the first breast cover, and the second lateral portion being concave at a second lateral side where the second lateral portion connects to the second breast cover.

13. The garment of claim 9, further comprising a third knitting pattern, the third knitting pattern disposed adjacent to the second knitting pattern.

14. The garment of claim 9, the second knitting pattern being ribbed.

15. A method of manufacturing a garment for nursing and pumping comprising:

producing a tubular knit piece of material that includes a first knitting pattern having a first breast cover and a second breast cover, a second knitting pattern having a bottom band and a central portion between the first breast cover and the second breast cover;

cutting or casting off the tubular knit piece of material circumferentially;

folding the tubular knit piece of material along the bottom band to create a unitary exterior layer and a pumping layer, the pumping layer integral with and seamlessly connected to the unitary exterior layer by the bottom band;

sewing the unitary exterior layer to the pumping layer along a neckline edge, a first armpit edge, and a second armpit edge, while leaving a first lateral pumping edge and a second lateral pumping edge of the exterior layer unbound and a central pumping edge of the pumping layer unbound;

attaching a first bra clip adjacent a first top edge and attaching a second bra clip adjacent a second top edge;

attaching a first bra strap to the tubular knit piece of material adjacent the first top edge, at the bottom band interiorly of the pumping layer, and at a first back location; and attaching a second bra strap to the tubular knit piece of material adjacent the second top edge, at the bottom band interiorly of the pumping layer, and at the bottom band at a second back location.

16. The method of manufacturing of claim 15, the second knitting pattern being ribbed.

17. The method of manufacturing of claim 15, wherein producing a tubular knit piece of material that includes a first knitting pattern having a first breast cover and a second breast cover, a second knitting pattern having a bottom band and a central portion between the first breast cover and the second breast cover tubular knit piece of material further comprises one or more of: (1) producing the tubular knit piece of material using a circular, flat or Warp knitting machine; or (2) forming gathers between the first breast cover and the central portion and gathers between the second breast cover and the central portion.

18. The method of manufacturing of claim 15, and sewing elastic along the first armpit edge, the second armpit edge, and the neckline edge.

19. The method of manufacturing of claim 15, and attaching a first strap clip to the first bra strap, the first strap clip selectively connectable to the first bra clip, and attaching a second strap clip to the second bra strap, the second strap clip selectively connectable to the second bra clip.

20. The method of manufacturing of claim 15, and the first lateral pumping edge curving convexly from the armpit edge toward the central portion, the second lateral pumping edge curving convexly from the second armpit edge toward the central portion, and the central pumping edge curving convexly from the neckline edge toward the bottom band.

* * * * *